US005366305A

United States Patent [19]

Christianson

[11] Patent Number: 5,366,305

[45] Date of Patent: Nov. 22, 1994

[54] TWO-LINE CONTACT CARRIAGE BEARING SUBSYSTEM

[75] Inventor: John A. Christianson, Vancouver, Wash.

[73] Assignee: Hewlett-Packard Company, Palo Alto, Calif.

[21] Appl. No.: 75,061

[22] Filed: Jun. 9, 1993

[51] Int. Cl.[5] ..... B41J 11/22

[52] U.S. Cl. ..... 400/354; 400/352; 400/139

[58] Field of Search ..... 400/352, 354, 354.1, 400/139, 154, 160; 384/26, 42

[56] References Cited

U.S. PATENT DOCUMENTS

| | | | |
|---|---|---|---|
| 3,112,627 | 12/1963 | Gissel | 384/42 |
| 3,626,113 | 12/1971 | Jones et al. | 179/100.25 |
| 3,942,438 | 3/1976 | Zimmer | 101/119 |
| 3,964,382 | 6/1976 | Baar et al. | 101/1 |
| 4,235,555 | 11/1993 | Aprato | 400/120 |
| 4,487,536 | 12/1984 | Rouzaud | 409/239 |
| 4,514,100 | 4/1985 | LaSpesa | 400/352 |
| 4,683,925 | 8/1987 | Koukal | 144/145 R |
| 4,744,686 | 5/1988 | Wakabayashi | 400/139 |
| 4,795,525 | 1/1989 | Kronseder | 156/567 |
| 4,898,487 | 2/1990 | Brull et al. | 400/354 |
| 5,074,688 | 12/1991 | Sato | 400/139 |
| 5,118,204 | 6/1992 | Peters | 384/42 |

FOREIGN PATENT DOCUMENTS

| | | | |
|---|---|---|---|
| 0120485 | 7/1984 | Japan | 400/354 |
| 2202165 | 1/1989 | Japan . | |
| 1129461 | 10/1968 | United Kingdom | 400/354.1 |
| 2145269 | 3/1985 | United Kingdom . | |

OTHER PUBLICATIONS

Plaza et al., "Carriage Support Apparatus"; Xerox Disclosure Journal, vol. 1 No. 5 May 1976 pp. 51–52.

Adams, Jr., "Shaft Mounting Apparatus"; IBM Technical Disclosure Bulletin, vol. 20 No. 4 Sep. 1977 p. 1293.

*Primary Examiner*—Edgar S. Burr

*Assistant Examiner*—Lynn D. Hendrickson

[57] ABSTRACT

A glide bearing subsystem is described. The invented bearing subsystem includes an expanse having a non-circularly cross-sectional through hole providing in a first, e.g. an upper, region thereof two arcuately spaced planar contact surfaces providing dual parallel lines of contact with a cylindrical rail upon which the carriage is mounted for reciprocal axial movement. A second, e.g. a lower, region of the hole generally opposite and preferably smoothly joining the first hole region is semi-cylindrical and of slightly greater diameter than that of the rail, thereby controlling inadvertent lift-off of the carriage during acceleration phases of its reciprocal movement along the rail. Preferably, the carriage has a pair of axially spaced bearings formed in generally planar thin expanses of oil-impregnated bronze, which expanses are made by a sintering process and are insert molded integrally with the printer's carriage.

13 Claims, 1 Drawing Sheet

TWO-LINE CONTACT CARRIAGE BEARING SUBSYSTEM

TECHNICAL FIELD

The present invention relates generally to glide bearings for carriages moving on rails. More specifically, it concerns a glide bearing subsystem that provides two spaced lines of contact between a carriage and a rail for increased dynamic stability of a reciprocating carriage. The invention is described and illustrated in the context of an ink-jet printer, although it is not limited thereto.

BACKGROUND ART

Typically, glide bearings in reciprocating carriage and rail systems such as those used in low-cost printers have used cylindrical holes of circular cross section slightly greater in diameter than that of the cylindrical rails of circular cross section rails reciprocating laterally therethrough. Such structures provide reasonable dynamic stability and long life. There are problems, however: such bearing structures provide a single line of contact at the point of tangency between the carriage and the rail, which line of contact tends to move in response to external forces. The result is a lack of control of the carriage relative to the rail and undesirable and uncontrollable fore and aft movement of the carriage that reduces print quality. The problem is worse during times of acceleration and deceleration of the carriage along the rail, as at either extreme of its reciprocal movement therealong.

DISCLOSURE OF THE INVENTION

The invented carriage bearing subsystem provides greatly increased dynamic stability to applications in which a carriage moves, e.g. reciprocates, axially along one or more rails to perform a given task, e.g. printing. The invented bearing subsystem preferably includes a pair of axially spaced, insert-molded, generally planar, thin, bronze expanses each having formed therein a non-circularly cross-sectional through hole providing in an upper region thereof two spaced lines of contact with the nickel-plated carbon steel rail upon which the carriage is supported for reciprocal movement. The tendency for the carriage to move undesirably generally within a plane normal to the rail's long axis, due, for example, to vibration, is virtually eliminated. Thus the positional accuracy of the carriage in following an ideally linear path along the rail is improved substantially. A lower region of each expanse's hole preferably smoothly joining the upper hole region in cross section is semicircular and of slightly greater diameter than that of the rail, thereby controlling any incidental lift-off of the carriage during its reciprocal movement along the rail. Preferably, the carriage is supported against rotation around the rail by a wheel that traverses a raceway extending in parallel with the rail.

These and additional objects and advantages of the present invention will be more readily understood after a consideration of the drawings and the detailed description of the preferred embodiment.

DETAILED DESCRIPTION OF THE PREFERRED EMBODIMENT AND BEST MODE OF CARRYING OUT THE INVENTION

Figure 1:
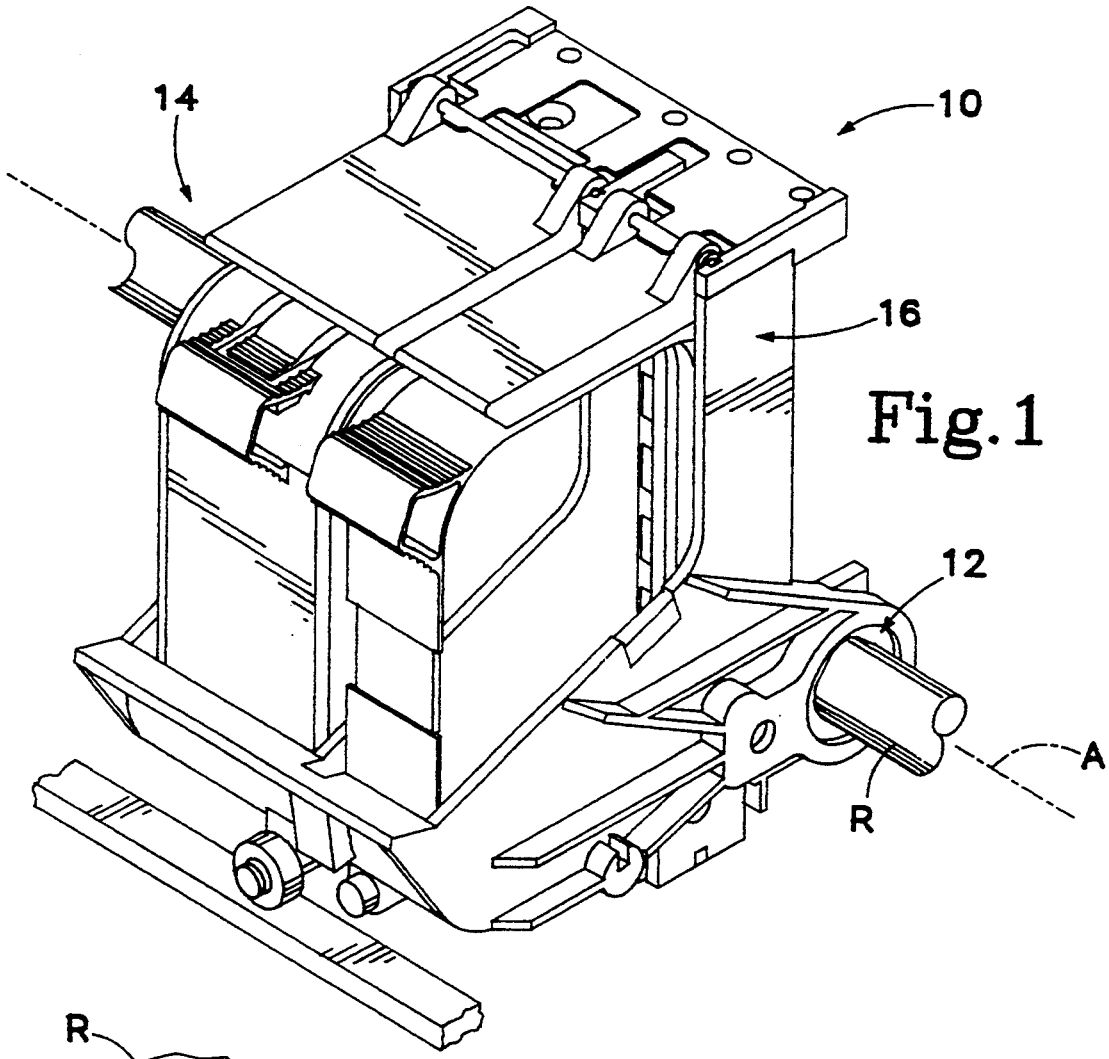
FIG. 1 is a fragmentary, isometric view of a carriage system illustrating the invented bearing subsystem made in accordance with a preferred embodiment.

FIG. 1 shows in isometric view a carriage system 10 featuring the invented subsystem including a pair of novel bearings indicated at 12, 14. Bearings 12, 14 may be seen to be situated in axially spaced and aligned relation on either side of a printhead carriage assembly indicated generally at 16. Preferably, bearings 12, 14 include generally planar expanses (identically designated herein) made of thin, flat bronze sheet material, and are integrally incorporated within carriage assembly 16 by an insert-molding process. Carriage assembly 16 is reciprocable axially along a linear, cylindrical rail R typically made of nickel-plated carbon steel or other suitable material by conventional drive means, e.g. a stepper motor and belt system (not shown).

Figure 2:
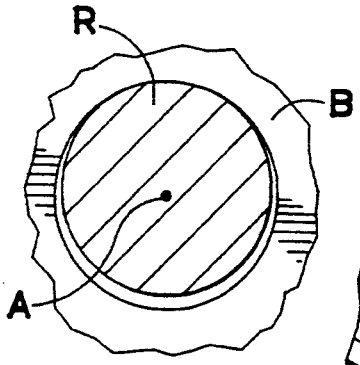
Fig. 2 (PRIOR ART)
FIG. 2 is an enlarged, fragmentary front elevation of a conventional carriage bearing, and illustrates some of the problems of the prior art.

Turning briefly now to FIG. 2, a conventional bearing is shown in fragmentary front elevation. Persons skilled in the art will appreciate that such prior art bearings, because they are circular in cross section, feature what will be referred to herein as single-line contact systems because, as may be seen, a circularly cross-sectional rail R extending through a circularly cross-sectional bearing B produces a singular, nominally dead center, line of contact at the point of tangency of rail R and bearing B. Although such bearings provide low sliding or gliding friction between rail R and bearing B due to the single line of contact, such undesirably tend to traverse the ideally top center contact line, e.g. to oscillate thereabout, or otherwise to move generally in a plane normal to the long axis A of rail R in response to incidental external forces. Depending upon the extent of such forces, bearing B and the carriage, for example, that it mounts for reciprocation along axis A may traverse the entire circular periphery of rail R producing substantial, uncontrollable chatter.

Such chatter may be permissible in certain low-cost applications. But such chatter, or uncontrolled movement in the plane normal to the rail's axis (illustratively, in the plane of FIG. 2), produces noticeably lower print quality in printer applications where print resolutions need be no less than approximately 300 dots per inch (DPI) and typically might be 600 DPI or higher. At such ink dot (or droplet) resolutions, uncontrolled movement normal to the rail's axis of $\leqq 1$ mil, i.e. $\leqq 0.025$ millimeter (mm), can cause seriously misplaced dots. Typically, such movement would not be random, but would represent motion artifacts of carriage movement, paper advancement, etc. and also would represent sympathetic resonances between various moving and stationary parts of the printer. It is seen that objectionably visible dot misplacement can result.

Figure 3:
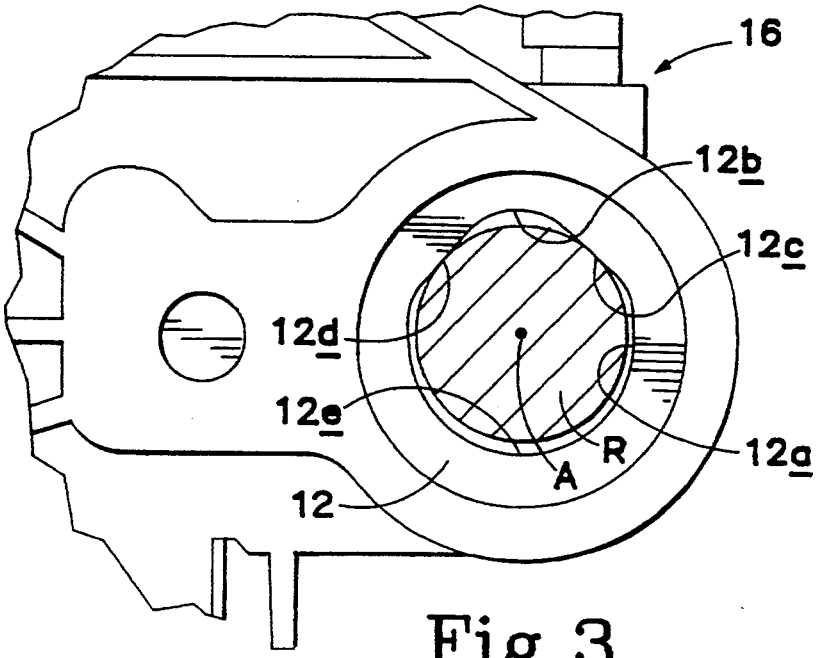
FIG. 3 is an enlarged, fragmentary front elevation of one of the invented bearings used in the subsystem shown in FIG. 1.

Referring finally to FIG. 3, one of the invented glide bearings is shown in enlarged, fragmentary, front elevational detail. Glide bearing 12 may be seen to feature a generally pear-shaped through hole **12*a* having in a generally inverted V-shaped, upper peripheral region 12*b* opposing, symmetrically arcuately spaced, substantially planar contact surfaces 12*c*, 12*d* located preferably at approximately 1:30 and 10:30 o'clock. Bearing 12** also may be seen to feature in a lower, preferably semicircular region 12e at bottom center a slight clearance between, or spacing from, rail R. Ideally, this clearance should be minimized, but non-zero. In practice, a clearance of as little its approximately 0.05 mm is believed to be achievable. Not indicated in FIG. 3 is the thickness of bearing 12, which preferably is approximately 3.0 mm.

It may be seen from FIG. 3 that, under the weight of carriage assembly 16 in which bearing 12 is insert-molded, rail R is positioned within hole 12a with its arcuately spaced bearing surfaces in contact with corresponding planar contact surfaces 12c, 12d in a more stable relationship resisting forces normal to axis A (between 10:30 and 1:30 o'clock) than is inherent in conventional bearing subsystems such as that shown in FIG. 2. It is this important bearing-rail contact configuration, which might be thought of as a tangent-flanking contact arrangement, that produces significant advantages of the invented bearing subsystem over conventional bearing subsystems. As may be seen from FIG. 3, gravity acts upon carriage-mounting bearing 12 to keep the bearing gliding along the rail with only these two bearing surfaces contacting the rail, thereby minimizing friction between the carriage and the rail and also minimizing relative movement therebetween other than the desired linear movement along long axis A of the rail.

The predetermined arcuate angle between contact surfaces 12c, 12d (or what might be thought of as an angle of intersection between two planes defined by contact surfaces 12c, 12d) preferably is between approximately 45 and 135 degrees, more preferably is between approximately 60 and 120 degrees, even more preferably is between approximately 75 and 105 degrees and most preferably is approximately 90 degrees. It is believed that 90 degrees nearly optimally permits contact surfaces 12c, 12d to maintain rail R in contact therewith and immobile therebetween in the plane normal to axis A. The shape of contact surfaces 12c, 12d preferably is planar, although it will be appreciated that other shapes, including relatively large-radius, concave or convex, cylindrical sections may be used. (It will be appreciated that there is wear, however slight, over time of these contact surfaces by their sliding frictional engagement with rail R—which will tend over time to wear into bearing 12 a slight convex curvature conforming generally with the outer contact surfaces of rail R—although a product life goal for the invented subsystem in the preferred embodiment described and illustrated herein in excess of five years is believed to be achievable.)

In accordance with a preferred embodiment of the invention, each of generally key-shaped bearings 12, 14 are approximately 36 mm long, with the generally round end being approximately 22 mm in radius. Preferably holes 12a, 14a formed therein are approximately 13 mm across, with upper, preferably semicircular region 12b being approximately 4 mm in radius and with lower, preferably semi-circular region 12e being approximately 6.5 mm in radius. Preferably all interior and exterior features of bearing 12 are smoothly rounded, e.g. with 2–3 mm radii. Critical tolerances, which include especially the periphery of hole 12a formed within bearing 12, typically do not exceed 0.07 mm. Persons skilled in the arts will appreciate that, within the spirit and scope of the invention as it may be used various reciprocal carriage applications, even relatively wide departures from such dimensions and tolerances may be permissible.

Those skilled in the arts will appreciate that the arcuate spacing of contact surfaces 12c, 12d and their peripheral extent within upper region 12b of bearing 12 are designed to accommodate the particular dynamics of the printer and its carriage 16. For example, it is desired that the reaction force vector describing the dynamics of the load bearing contact interface between bearings 12, 14 and rail R is maintained always as positive with respect to both contact surfaces and is maintained always between the fore and aft extremes of the contact surfaces. In such a desired condition, despite dynamic forces tending to urge carriage-supporting bearing 12 fore or aft, thereby potentially producing lift-off of one or both of its contact surfaces from their corresponding rail surfaces, the probability of such undesirable lift-off is minimized and preferably eliminated.

It will be appreciated that typically there is no printing during acceleration and deceleration of carriage assembly 16 by its motor and belt drive subsystem. Accordingly, the risk of acceleration-produced lift-off is virtually eliminated. There still are dynamic forces impacting fore and aft between carriage 16 and rail R, e.g. from glide or roller bearing surface imperfections or from other printer dynamics and environmental conditions, so that it is important to maintain the described and illustrated configurational and dimensional tolerances of contact surfaces 12c, 12d of bearing 12; those of corresponding contact surfaces 14c, 14d of bearing 14 (not shown): their axial alignment with one another and with axis A of rail R; and the rigidity, linearity and smoothness of rail R; the parallel alignment of rail R and the raceway on which the bearing wheel of carriage 16 rolls; etc.

It is noted that, in accordance with the preferred embodiment of the invention, hole 12a is inclined slightly upwardly and forwardly (counter-clockwise in FIG. 3) by approximately 3.7°. This will be understood to accommodate the particular statics and dynamics of the printer system of which the invented subsystem is a part, and forms no necessary part of the invention. As described above, contact surfaces 14c, 14d of bearing 14 ideally are located and oriented to contact rail R such that any oscillatory force vector thereat is maintained between the two defined lines of contact. thereby to eliminate movement of carriage 16 relative to rail R in a plane normal to axis R. It is thought that defining the bearing hole symmetrically around a generally vertical centerline and then canting the hole if necessary when it is formed in its corresponding expanse is the most straightforward manner in which design and manufacturing cost goals are attained. It will be understood in this connection that the axially spaced bearing expanses, only one of which is visible in FIG. 1, are identically formed, and then insert-molded with carriage 16, as suggested thereby.

Preferably, bearings 12, 14 are made by a sintering process or other process that permits the finished sintered bearings each to have a desirable oil content, e.g. greater than approximately 19 percent by volume, that promotes lubrication of rail R. Those of skill in the arts will appreciate that, by such manufacturing process, bearings 12, 14 effectively ride along rail R within the printer or other reciprocating carriage application on a thin film of oil. Other suitable processes of manufacturing bearings 12, 14, within the spirit and scope of the invention, may be used.

Those skilled in the art will appreciate that other hole-peripheral regions within bearing 12 are far less important than those described in detail above, as they ideally are inoperative, or non-contacting surfaces. Nevertheless, they preferably are shaped generally as illustrated, in accordance with the preferred embodiment of the invention, in order to provide structural integrity to the bearings and to render the bearings more easily and inexpensively manufactured.

The invention may be characterized broadly to be a glide bearing subsystem for use in a printer having a cylindrical rail for supporting a printhead carriage reciprocable along an axis defined by the rail, the glide bearing subsystem receiving the rail. Preferably, such bearing subsystem includes dual axially spaced bearing expanses such as expanses 12, 14 fixedly connected, e.g. insert-molded, with a printhead carriage 16, each expanse such as expanse 12 having a bore or hole 12*a* formed therein for receiving a cylindrical rail R therethrough. Preferably, each expanse such as expanse 12 in a hole-peripheral first region 12*b* thereof further has a symmetrically opposing pair of glide surfaces 12*c*, 12*d* for engaging rail R along a pair of corresponding surfaces thereof, with each of the pair of glide surfaces, e.g. glide surfaces 12*c*, 12*d* of expanse 12 (and also corresponding glide surfaces 14*c*, 14*d* of expanse 14, not shown in FIG. 3), forming an approximately right angle therebetween. Preferably, each expanse such as expanse 12 in a hole-peripheral second region 12*e* thereof generally opposite first region 12*b* is spaced from the corresponding pair of glide surfaces 12*c*, 12*d* sufficiently to provide slight clearance, e.g. preferably between approximately 0.05 mm and 0.15 mm, from rail R extending therethrough in contact with the corresponding pair of glide surfaces 12*c*, 12*d*.

Another way of characterizing the invented bearing subsystem for use in a printer having a reciprocable printhead carriage is that such includes 1) a generally cylindrical elongate rail R for mounting a carriage 16 for reciprocal movement of the latter, and 2) one or more carriage-mounted laterally spaced bearings such as bearing 12 each including an expanse having formed therein a generally pear-shaped hole 12*a* for receiving rail R therethrough, with hole 12*a* in a smaller region 12*b* thereof having two-line contact, or preferably arcuately spaced dual contact, surfaces 12*c*, 12*d* for engaging rail R.

Preferably, each of the contact surfaces such as surfaces 12*c*, 12*d* of bearing 12 is substantially planar, and may for example have a peripheral extent of approximately 3–4 mm and an axial extent of the approximately 3.0 mm thickness of the expanse. Preferably, contact surfaces 12*c*, 12*d* are arcuately separated by approximately ninety degrees, although within the spirit and scope of the invention other angles may be used. In accordance with the preferred embodiment of the invention in which the force of carriage 16 presses downwardly upon rail R, expanses 12*c*, 12*d* are located in upper region 12*b* of hole 12*a* and symmetrically relative to a generally vertical center line of hole 12*a*, as best illustrated in FIG. 3. Also in accordance with such application, generally central, lower region 12*e* of each of the holes (including also a generally central, lower region 14*e* of hole 14*a* of expanse 14, not shown in FIG. 3) is spaced from the corresponding contact surfaces sufficiently to provide slight clearance from rail R, as described above and best illustrated in FIG. 3. In accordance with the best known mode of carrying out the invention, expanses 12, 14 are made of oil-impregnated bronze by sintering, and are insert-molded integrally with carriage 16, as illustrated in FIGS. 1 and 2.

Those skilled in the art will appreciate that the invention is broadly applicable to load bearing subsystems in which the force of the carriage presses at any angle upon, and in any region of, the rail, and thus that other bearing configurations are possible that are within the spirit and scope of the invention. An example is illustrative. If the center of mass of the carriage were fore, rather than aft, of the raceway illustrated in FIG. 1, then the force of the carriage would press upwardly on rail R, and the invented bearing to be effective might be oriented generally opposite the orientation shown in FIG. 3, i.e. with the contact surfaces located in a bottom region of the hole and with the semi-circularly cross-sectional clearance located in an upper region thereof. Thus, different static forces of impingement between the carriage and the bearing require different orientations of what has been described herein as a pear-shaped hole, with the operative tangent-flanking glide contact surfaces generally opposing the load exerted on the inside of the bearing by the rail.

Yet another way of characterizing the invented carriage bearing subsystem for use in such a printer is that it includes 1) a generally cylindrical elongate rail R for mounting a carriage 16 for reciprocal movement of the latter, and 2) one or more carriage-mounted laterally spaced bearings 12, 14 each including an expanse having formed therein a hole such as hole 12*a* for receiving rail R therethrough. Preferably, such hole 12*a* in a first, e.g. an upper, region 12*b* thereof has dual substantially planar contact surfaces 12*c* 12*d* for engaging rail R, such contact surfaces being substantially symmetrically located relative to a generally vertical center line of hole 12*a* and such contact surfaces being arcuately separated by between approximately 60 and 120 degrees. In accordance with the preferred embodiment of the invention, a second, e.g. a generally central, lower region of each hole, e.g. region 12*e* of hole 12*a*, is spaced from the contact surfaces sufficiently to provide predeterminedly slight clearance, e.g. between approximately 0.05 mm and 0.15 mm, from rail R. As described above, preferably such expanses are made of sintered, oil-impregnated bronze, and the oil content by volume of such bronze expanses (at least in its operative regions surrounding contact surfaces 12*c*, 12*d*) is greater than approximately 19 percent, although of course other suitable materials and processes may be used.

INDUSTRIAL APPLICABILITY

It may be understood that the invented glide bearings used in a carriage subsystem of, for example, an ink-jet printer provide many advantages over conventional glide bearings. Instead of relying on a single line of contact between a circularly cross-sectional glide bearing and its slightly undersized circularly cross-sectional rail, which reliance undesirably produces dynamic instability in positionally low-tolerance, moveable-carriage applications, the invented carriage bearing subsystem relies instead on an inherently more stable two-line contact configuration the oppositely reactive bearing contact surfaces of which oppose inadvertent fore and aft motion of the carriage relative to the rail. Yet, such invented bearing subsystem is easily manufactured, without exotic materials or processes, at a cost that is comparable to that of conventional subsystems. The result of the use of such an improved bearing subsystem in the illustrated ink-jet printer application is greatly improved print quality and long-term reliability.

While the present invention has been shown and described with reference to the foregoing preferred embodiment, it will be apparent to those skilled in the art that other changes in form and detail may be made therein without departing from the spirit and scope of the invention as defined in the appended claims.

I claim:

1. For use in a printer having a printhead carriage and a cylindrical rail which supports the printhead carriage for reciprocation along an axis defined by the rail, a glide bearing subsystem for receiving the rail, the subsystem comprising:

dual axially spaced bearing expanses fixedly connected with a printhead carriage, each expanse having a hole formed therein for receiving a cylindrical rail therethrough, each hole defining a hole-peripheral first region having a symmetrically opposing pair of arcuately spaced glide surfaces for engaging the rail along a pair of corresponding surfaces of the rail, each of said pair of glide surfaces forming an approximate right angle therebetween, each expanse supporting the carriage slidably on the rail, and having a hole-peripheral second region spaced from said corresponding pair of glide surfaces sufficiently to provide slight clearance from the rail extending therethrough in contact with said corresponding pair of glide surfaces.

2. For use in a printer having a reciprocable printhead carriage, a glide bearing subsystem comprising:

a generally cylindrical elongate rail for mounting a carriage for reciprocal movement of the carriage, and one or more carriage-mounted laterally spaced bearings each including an expanse having formed therein a generally pear-shaped hole for receiving said rail therethrough, said hole being dividable into hole-peripheral first and second regions wherein said first region defines an area which is smaller than an area defined by said second region such that said first region provides arcuately spaced dual contact surfaces which engage said rail to support the carriage slidably on said rail.

3. The subsystem of claim 2, wherein each of said contact surfaces is substantially planar.

4. The subsystem of claim 2, wherein said contact surfaces are arcuately separated by approximately ninety degrees.

5. The subsystem of claim 2, wherein said surfaces are symmetrically located relative to a generally vertical center line of said hole.

6. The subsystem of claim 2, wherein said hole-peripheral second region of each of said holes is generally opposite said first region and is spaced from said contact surfaces sufficiently to provide slight clearance from said rail.

7. The subsystem of claim 2, wherein said expanses are insert-molded integrally with the carriage.

8. The subsystem of claim 2, wherein said expanses are made of oil-impregnated bronze.

9. The subsystem of claim 8, wherein said expanses are made by sintering.

10. For use in a printer having a reciprocable printhead carriage, a glide bearing subsystem comprising:

a generally cylindrical elongate rail for mounting a carriage for reciprocal movement of the carriage, said rail bearing a generally downward force exerted by the carriage, and one or more carriage mounted laterally spaced bearings each including an expanse having formed therein a hole for receiving said rail therethrough, said hole defining a hole-peripheral upper region with dual, substantially planar contact surfaces which engage said rail to slidably support the carriage, said contact surfaces being substantially symmetrically located relative to a generally vertical center line of said hole and being arcuately separated by between approximately 60 and 120 degrees, a lower region of said hole being spaced from said contact surfaces sufficiently to provide predeterminedly slight clearance from said rail.

11. The subsystem of claim 10, wherein said expanses are insert-molded integrally with the carriage.

12. The subsystem of claim 11, wherein said expanses are made of sintered oil-impregnated bronze.

13. The subsystem of claim 12, wherein the oil content by volume of said expanses is greater than approximately 19 percent.

* * * * *